US005815075A

United States Patent [19]

Lewiner et al.

[11] Patent Number: 5,815,075

[45] Date of Patent: Sep. 29, 1998

[54] FIRE DECTOR INCLUDING A NON-VOLATILE MEMORY

[76] Inventors: Jacques Lewiner, 7 avenue de Suresnes-92210, Saint-Cloud; Eugeniusz Smycz, 4 rue du Val Fleury-91240, St-Michel sur Orge, both of France

[21] Appl. No.: 776,424

[22] PCT Filed: Jul. 27, 1995

[86] PCT No.: PCT/FR95/01011

§ 371 Date: Jun. 5, 1997

§ 102(e) Date: Jun. 5, 1997

[87] PCT Pub. No.: WO96/04623

PCT Pub. Date: Feb. 15, 1996

[30] Foreign Application Priority Data

Jul. 29, 1994 [FR] France ..... 94 09476

[51] Int. Cl.[6] ..... G08B 29/00

[52] U.S. Cl. ..... 340/506; 340/511; 340/514; 340/628

[58] Field of Search ..... 340/628, 629, 340/630, 577, 578, 579, 693, 506, 511, 514, 588, 589, 825.06; 364/188

[56] References Cited

U.S. PATENT DOCUMENTS

| | | | |
|---|---|---|---|
| 4,465,904 | 8/1984 | Gottsegen et al. | 340/518 |
| 4,581,606 | 4/1986 | Mallory | 340/518 |
| 4,855,713 | 8/1989 | Brunius | 340/506 |
| 5,408,217 | 4/1995 | Sanderford, Jr. | 340/506 |

FOREIGN PATENT DOCUMENTS 0 141 162 9/1984 European Pat. Off. .

OTHER PUBLICATIONS

French Search Report, dated 21 Apr., 1995, French Appl. No. FR9409476.

International Search Report, Appl. No. PCT/FR95/01011.

Havant, "Smoke Detector With Dirty Chamber Signal", Reasearch Disclosure No. 357, Jan. 1994, Emsworth, GB, pp. 8–13.

Tavora, "The Remote Link Unit–An Advanced Remote Terminal Concept," IEEE Transactions on Industrial Electronics, vol. 26, No. 3, New York (Aug. 26, 1979).

Mayr et al., "Module Documentation Chip," IBM Technical Disclosure Bulletin, vol. 26, No. 8, Jan. 1984.

*Primary Examiner*—Jeffery A. Hofsass
*Assistant Examiner*—Shiong Huang
*Attorney, Agent, or Firm*—Marshall, O'Toole, Gerstein, Murray & Borun

[57] ABSTRACT

The invention relates to fire detector comprising a CPU and a sensor providing an analog measurement signal to the CPU. The CPU includes a non-volatile memory in which at least one normal value for the measurement signal and maintenance dates are recorded, the fire detector also including an interface giving access to the contents of the non-volatile memory without disassembling the fire detector. On each occasion that maintenance has been performed, a new maintenance date is recorded in the non-volatile memory. Nevertheless, such recordal is prevented if the measurement signal differs excessively from its normal value.

7 Claims, 1 Drawing Sheet

FIRE DECTOR INCLUDING A NON-VOLATILE MEMORY

FIELD OF THE INVENTION

The present invention relates to fire detectors including a non-volatile memory.

More particularly, the invention relates to a fire detector comprising:

- a CPU including a non-volatile memory in which a code is recorded representative of at least one characteristic element specific to said fire detector; and
- a fire sensor that measures a physical magnitude whose variation serves to detect the existence of a fire in the vicinity of the fire detector, said fire sensor delivering an analog electrical signal referred to as a "measurement" signal to the CPU, the value of the measurement signal being representative of the physical magnitude measured by the fire sensor, the above-mentioned characteristic element including a normal value iO for the measurement signal in the absence of a fire.

BACKGROUND OF THE INVENTION

Such a fire detector is disclosed in the document: Research Disclosure No. 357, January 1995 (Emsworth, GB, "Smoke detector with dirty chamber signal").

Fire detectors of the kind in question need to be maintained at regular time intervals in order to keep them reliable.

Nevertheless, when several types of fire detector are installed in the same building, or when the fire detectors are installed at different dates, it can happen that detectors need to be maintained at different dates.

Managing such maintenance then becomes complex, particularly since it can happen that the fire detectors were interchanged or replaced on the last occasion they were dismantled for maintenance: under such circumstances, it is extremely difficult for maintenance personnel to identify exactly which fire detectors need to be maintained at a given date, particularly since such detectors are generally difficult of access.

Also, it is usual for maintenance services to be content with observing the date of the last occasion on which a fire detector was dismantled for maintenance purposes, without always systematically verifying in reliable manner that the maintenance was effective. Consequently, if the periodic maintenance of a fire detector is poorly performed, it can subsequently give unreliable information, at least until the next date on which it is dismantled for maintenance.

OBJECTS AND SUMMARY OF THE INVENTION

A particular object of the present invention is to mitigate these drawbacks.

To this end, according to the invention, a fire detector of the kind in question further includes interface means giving access to the contents of the non-volatile memory without dismantling the fire detector, (i.e. in particular without removing its base, or without unscrewing it from the ceiling, or without opening its housing), the non-volatile memory further includes dates on which maintenance operations of said fire detector have been preformed, and the CPU is programmed to compare the measurement signal with the normal value iO of the measurement signal on each occasion that it receives an instruction from the interface means to record a maintenance date, and to refuse to record it whenever the measurement signal does not lie within the range iO−Δ1 to iO+Δ2, where Δ1 and Δ2 are predetermined values.

By means of these dispositions, maintenance services can easily access at least the most recent date of preventative maintenance on each fire detector, and can do this without needing to dismantle the fire detector, which is often difficult to access since it is located at a height.

Maintenance services can thus determine easily and reliably whether a particular fire detector needs preventative maintenance.

Also, because the new maintenance date on each operation of preventative maintenance is recorded in the non-volatile memory of the detector only if said maintenance has made it possible to bring the measurement signal in the absence of fire to a value that is sufficiently close to the normal value iO, it is easy to detect which fire detectors have been poorly maintained or insufficiently maintained, and this can be done without waiting for the next round of preventative maintenance. Consequently, the reliability of fire detection is improved.

In preferred embodiments of the invention, use is also made of one or more of the following dispositions:

- the interface means comprise a connector connected to the CPU, the connector being capable of receiving a complementary connector connected to an external compliance for the purpose of putting said external appliance into communication with the CPU;
- the interface means comprise a communications link between the fire detector and an alarm center: this embodiment is particularly advantageous in that it makes it possible from an alarm center to discover at least the date of the most recent maintenance on all of the fire detectors connected to said alarm center;
- the above-mentioned characteristic element further includes the date on which said detector was manufactured;
- the above-mentioned characteristic element further includes an identification number specific to said detector;
- the non-volatile memory further contains, for each maintenance date, the value of the measurement signal transmitted to the CPU by the fire sensor at the moment of recording said measurement date; and
- the normal value iO of the measurement signal is a value measured in the absence of a fire by the fire sensor under consideration, during manufacture or on first commissioning.

BRIEF DESCRIPTION OF THE DRAWING

Other characteristics and advantages of the invention appear from the following detailed description of an embodiment thereof, given as a non-limiting example and with reference to the accompanying drawing.

In the drawing, the sole FIGURE shows a fire detector constituting an embodiment of the invention, connected to an alarm center, and suitable for being connected to an external interface unit.

MORE DETAILED DESCRIPTION

Figure 1:
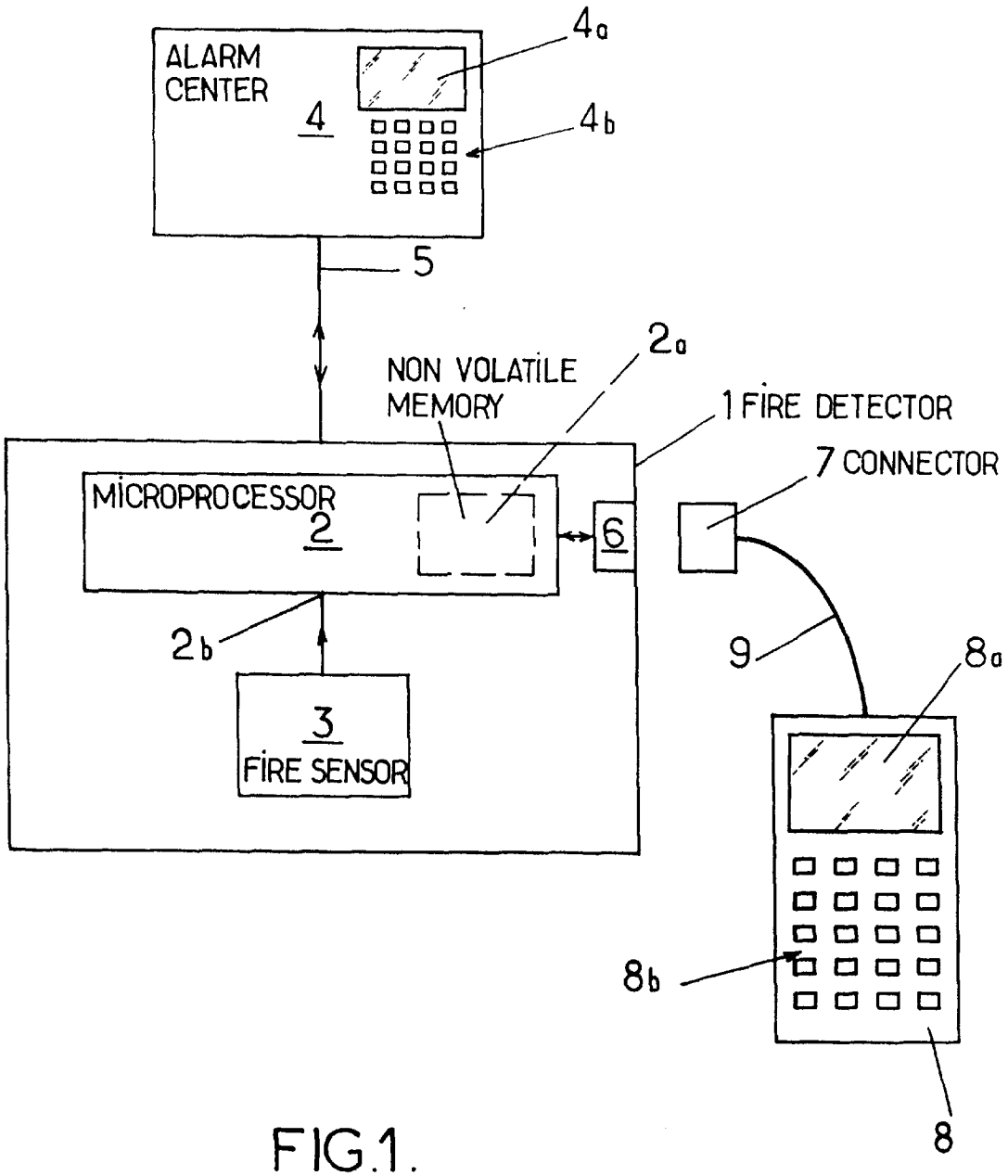

The fire detector 1 of the invention contains a microprocessor 2 including a non-volatile memory 2*a*, in particular of the EEPROM type. More generally, the fire detector 1 contains a CPU which includes a programmable electronic circuit such as a microprocessor and a non-volatile memory which may optionally be included or not included in the microprocessor.

The microprocessor 2 has an analog input 2*b* connected to a fire sensor 3, which fire sensor measures a physical magnitude whose variations serve to detect the existence of a fire in the vicinity of the fire detector 1. The fire sensor 3 may be an ion smoke sensor, an optical smoke sensor, a thermal sensor, etc.

The fire sensor 3 applies an analog electrical signal i, referred to as a "measurement" signal, to the analog input 2*b* of the microprocessor. The value thereof is representative of the physical magnitude measured by the fire sensor. The value of the signal i representative of the measured physical magnitude may, for example, be the current or the voltage of said signal.

The microprocessor 2 compares the measurement signal i with a normal value iO for said measurement signal in the absence of any fire, and when the measurement signal i is sufficiently remote from its normal value iO, the microprocessor 2 decides that a fire exists in the vicinity of the fire detector 1 and it responds, e.g. by sending an alarm message to an alarm center 4 over a link which preferably also serves to convey messages from the alarm center 4 to the microprocessor 2.

The non-volatile memory 2*a* of the microprocessor 2 includes not only the above-mentioned normal value iO, as measured immediately after manufacture of the fire detector 1 or after first commissioning thereof, but also the date of maintenance operations to which the detector has been subjected, or at least the date of the most recent maintenance operation. In addition, the non-volatile memory 2*a* preferably also includes the date of manufacture and the serial number specific to the fire detector 1.

The above data is accessible to a user from the alarm center 4 which may be provided for this purpose with a screen 4*a* and a key pad 4*b*, for example.

It is thus very easy to plan maintenance of the various fire detectors in a complete installation, and to verify the references of a particular fire detector in the installation, without needing to access said detector physically, which detector is generally located beneath a ceiling, and is thus difficult of access.

In addition, the fire detector 1 includes a connector 6 connected to the microprocessor 2.

After maintenance operations on the fire detector 1, while said detector is dismantled, it is thus possible to connect a complementary connector 7 to the connector 6, which complementary connector is itself connected to an interface unit 8 via a cable 9, the interface unit 8 having, for example, a screen 8*a* and a key pad 8*b*.

Thus, at the end of the maintenance operations, it is possible to record the date of said maintenance operations in the non-volatile memory 2*a* by means of the interface unit 8.

The microprocessor 2 is programmed to compare the value of the measurement signal i with said normal value iO when said microprocessor receives from the interface unit 8 an order to record the date of maintenance.

If said value i of the measurement signal does not lie in the range iO−Δ1 to iO+Δ2, where Δ1 and Δ2 are predetermined values (e.g. Δ1 and Δ2 may both be 5% of iO), the microprocessor 2 is programmed to refuse to record the date of maintenance in its non-volatile memory 2*a* and to return a message indicating such refusal to the interface unit 8.

In this way, the microprocessor 2 can monitor the effectiveness of maintenance operations, and said effectiveness can also be monitored from the alarm center 4 if the fire detector has been put back into place in spite of refusing to record the most recent date of maintenance.

Naturally, and as can be seen from the above, the invention is not limited in any way to those applications and implementations that have been envisaged more specifically; on the contrary, it extends to all variants thereof.

We claim:

1. A fire detector (1) comprising:

a CPU (2) including a non-volatile memory (2*a*) in which a code is recorded representative of at least one characteristic element specific to said fire detector; and a fire sensor (3) that measures a physical magnitude whose variation serves to detect the existence of a fire in the vicinity of the fire detector, said fire sensor delivering an analog electrical signal (i) referred to as a "measurement" signal to the CPU (2), the value of the measurement signal being representative of the physical magnitude measured by the fire sensor, the above-mentioned characteristic element including a normal value iO for the measurement signal in the absence of a fire;

the detector being characterized in that:

the fire detector further includes interface means (5, 6) giving access to the contents of the non-volatile memory (2*a*) without dismantling the fire detector;

the non-volatile memory (2*a*) further includes dates on which maintenance operations of said fire detector have been performed; and the CPU (2) is programmed to compare the measurement signal (i) with the normal value iO of the measurement signal on each occasion that it receives an instruction from the interface means (5, 6) to record a maintenance date, and to refuse to record it whenever the measurement signal (i) does not lie within the range iO−Δ1 to iO+Δ2, where Δ1 and Δ2 are predetermined values.

2. A fire detector according to claim 1, in which the interface means comprise a connector (6) connected to the CPU (2), the connector (6) being capable of receiving a complementary connector (8) connected to an external compliance (7) for the purpose of putting said external appliance into communication with the CPU (2).

3. A fire detector according to claim 1, in which the interface means comprise a communications link (5) between the fire detector and an alarm center (4).

4. A fire detector according to any preceding claim, in which the above-mentioned characteristic element further includes the date on which said detector was manufactured.

5. A fire detector according to any preceding claim, in which the above-mentioned characteristic element further includes an identification number specific to said detector.

6. A fire detector according to any preceding claim, in which the non-volatile memory (2*a*) further contains, for each maintenance date, the value (i) of the measurement signal transmitted to the CPU (2) by the fire sensor (3) at the moment of recording said maintenance date.

7. A fire detector according to any preceding claim, in which the normal value iO of the measurement signal is a value measured in the absence of a fire by the fire sensor (3) under consideration, during manufacture or on first commissioning.

* * * * *